US006881036B2

(12) United States Patent
Hornick et al.

(10) Patent No.: US 6,881,036 B2
(45) Date of Patent: Apr. 19, 2005

(54) COMPOSITE INTEGRALLY BLADED ROTOR

(75) Inventors: David Charles Hornick, East Hampton, CT (US); Frank J. Euvino, Jr., Naugatuck, CT (US); James Tyler Roach, East Hampton, CT (US)

(73) Assignee: United Technologies Corporation, Hartford, CT (US)

( * ) Notice: Subject to any disclaimer, the term of this patent is extended or adjusted under 35 U.S.C. 154(b) by 100 days.

(21) Appl. No.: 10/235,025

(22) Filed: Sep. 3, 2002

(65) Prior Publication Data

US 2004/0042902 A1 Mar. 4, 2004

(51) Int. Cl.[7] ..... F04D 5/24
(52) U.S. Cl. ..... 416/189; 416/230; 416/234
(58) Field of Search ..... 416/189, 226, 416/230, 234, 244 A

(56) References Cited

U.S. PATENT DOCUMENTS

| | | | | |
|---|---|---|---|---|
| 3,403,844 A | * | 10/1968 | Stoffer | 416/230 |
| 3,456,917 A | * | 7/1969 | Palfreyman et al. | 416/230 |
| 4,098,559 A | * | 7/1978 | Price | 416/230 |
| 4,747,900 A | | 5/1988 | Angus | |
| 4,786,347 A | | 11/1988 | Angus | |

* cited by examiner

*Primary Examiner*—Edward K. Look
*Assistant Examiner*—Richard A Edgar
(74) *Attorney, Agent, or Firm*—Bachman & LaPointe, P.C.

(57) ABSTRACT

The present invention relates to an integrally bladed rotor for use in a gas turbine engine. The integrally bladed rotor comprises a plurality of pairs of airfoil blades. Each pair of blades has a spar which extends from a first tip of a first one of the airfoil blades in the pair to a second tip of a second one of the airfoil blades in the pair. The rotor further comprises an outer shroud integrally joined to the first and second tips in each pair of airfoil blades and an inner diameter hub.

6 Claims, 3 Drawing Sheets

COMPOSITE INTEGRALLY BLADED ROTOR

BACKGROUND OF THE INVENTION

The present invention relates to an organic matrix composite integrally bladed rotor for use in gas turbine engines.

Gas turbine engine discs having integral, radially extending airfoil blades and an integral shroud interconnecting the radially outer extents of the blades is known in the art. Such a construction is shown in U.S. Pat. No. 4,786,347 to Angus. In the Angus patent, the airfoil blades and the disc are formed from an epoxy resin matrix material having chopped carbon fibers therein.

U.S. Pat. No. 4,747,900, also to Angus, illustrates a compressor rotor assembly comprising a shaft and at least one disc having integral radially extending airfoil blades, which disc is integral with the shaft. The assembly comprises a matrix material in which a plurality of short reinforcing fibers are so disposed that the majority thereof within the shaft are generally axially aligned while the majority thereof within the airfoil blades are generally radially aligned. At least one filament wound support ring provides radial support for the airfoil blades.

It is known to use titanium, hollow blade, integrally bladed fan rotors in gas turbine engines. Unfortunately, this type of bladed fan rotor is heavy. Thus, there is a need for a more lightweight integrally bladed rotor.

SUMMARY OF THE INVENTION

Accordingly, it is an object of the present invention to provide an integrally bladed rotor which offers a significant weight reduction and cost savings.

It is a further object of the present invention to provide an integrally bladed rotor as above which eliminates the possibility of a full blade out.

The foregoing objects are attained by the integrally bladed rotor of the present invention.

In accordance with the present invention, an integrally bladed rotor suitable for use in a gas turbine engine is provided. The integrally bladed rotor broadly comprises a plurality of pairs of airfoil blades with each pair of blades having a spar which extends from a first tip of a first one of the airfoil blades in the pair to a second tip of a second one of the airfoil blades in the pair. The integrally bladed rotor may, or may not, further comprise an outer shroud integrally joined to the first and second tips in each pair of airfoil blades.

Other details of the organic matrix composite integrally bladed rotor of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
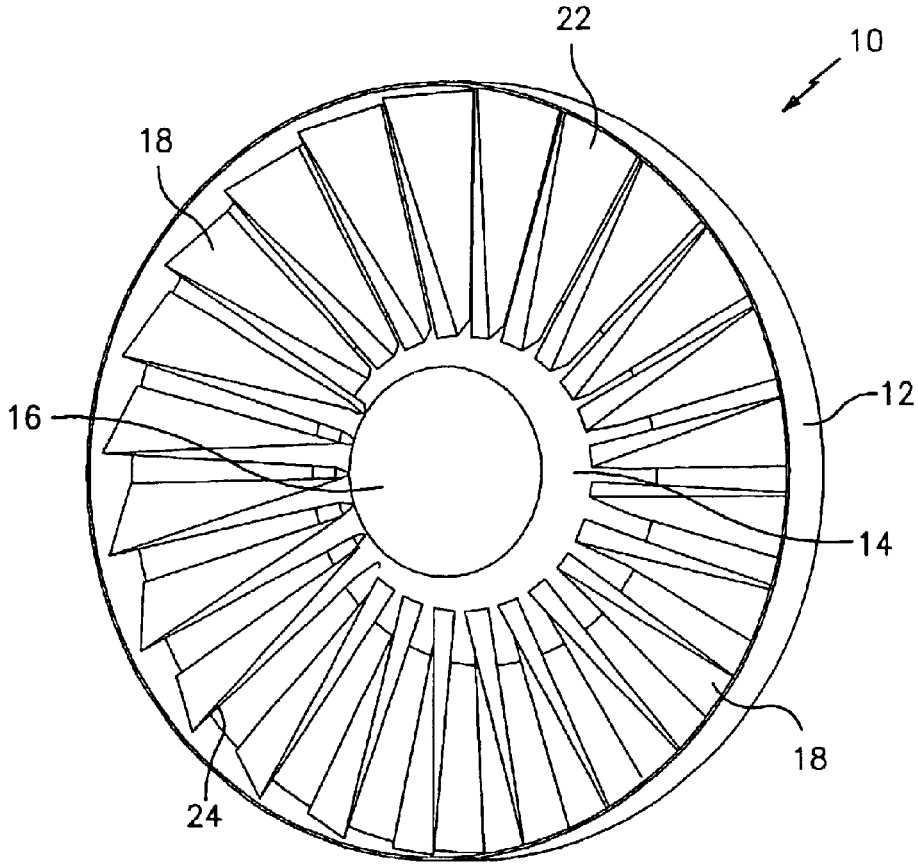
FIG. 1 is a perspective view of a composite integrally bladed rotor assembly in accordance with the present invention.

Referring now to the drawings, FIG. 1 illustrates an integrally bladed rotor assembly 10 in accordance with the present invention. The assembly 10 includes an outer shroud 12, an inner diameter hub 14, a stacked ply assembly 16 within the inner diameter hub, and a plurality of pairs of airfoil blades 18 extending between the inner diameter hub 14 and the outer shroud 12.

Figure 2:
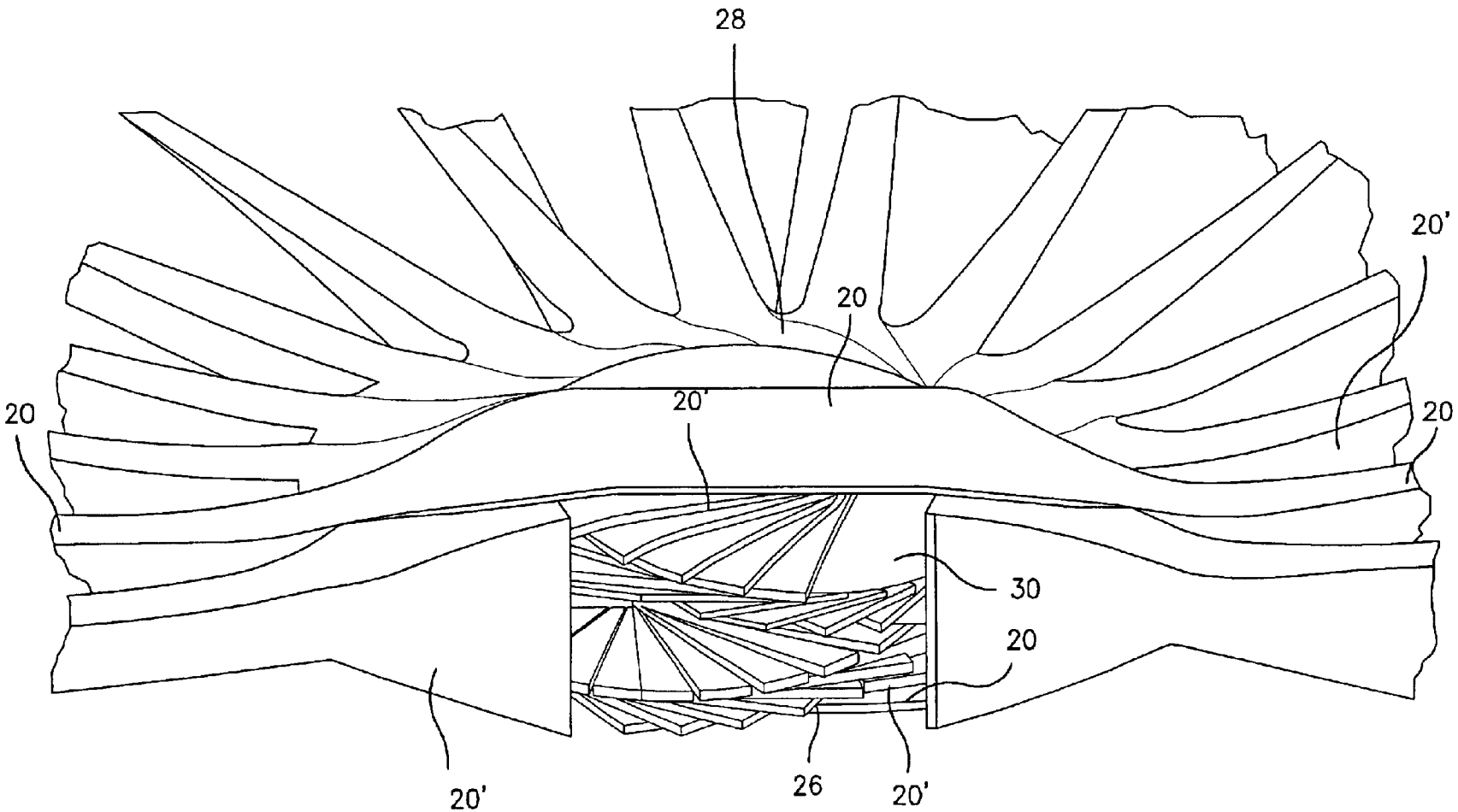
FIG. 2 is a partial sectional view of the integrally bladed rotor assembly of FIG. 1.

Referring now to FIG. 2, each pair of airfoil blades 18 has a spar 20 which extends from a first tip 22 of a first one of the airfoil blades 18 in the pair to a second tip 24 of a second one of the airfoil blades 18 in the pair. As can be seen from FIG. 2, each spar 20 in a central region has a first arm 26 and a second arm 28 spaced from the first arm 26 and defining an opening 30 with the first arm 26. The size of the openings 30 will vary from one spar 20 to the next. This allows the spars 20 to be interwoven or interleaved in a spiral pattern. This can be seen by comparing the spar 20 to the spar 20' in FIG. 2. As the spar 20 runs through the blade 18, it will taper towards the tip of the blade 18.

The outer shroud 12 and the inner diameter hub 14 may be integrally formed with the airfoil blades 18. When integrally formed, a number of advantages are provided. They include the following: (1) blade twist/untwist will be controlled, thus leading to the elimination of stresses at the root of the blade; (2) vibratory frequency of the blade will be increased leading to a reduction in structural requirements and a weight reduction; (3) blade out containment will be integrated into the structure; and (4) blade tip leakage will be eliminated. The integrally formed outer shroud 12 also allows more aggressive forward sweep of the blades 18.

Each of the spars 20 and 20' is preferably formed from an organic matrix composite material having reinforcing fibers running through the center in tension. The continuous reinforcing fibers are so disposed that the majority thereof within the spar 20 and 20' are generally axially aligned with the longitudinal axis of the spar. One material which may be used to form the spars 20 and 20' is an epoxy matrix material having carbon fibers therein. Other materials which may be used may have a matrix formed from a non-organic material such as metal, polyamide, and bismaliamide and/or a fiber reinforcement formed from glass, boron, fiberglass, and KEVLAR.

Figure 3:
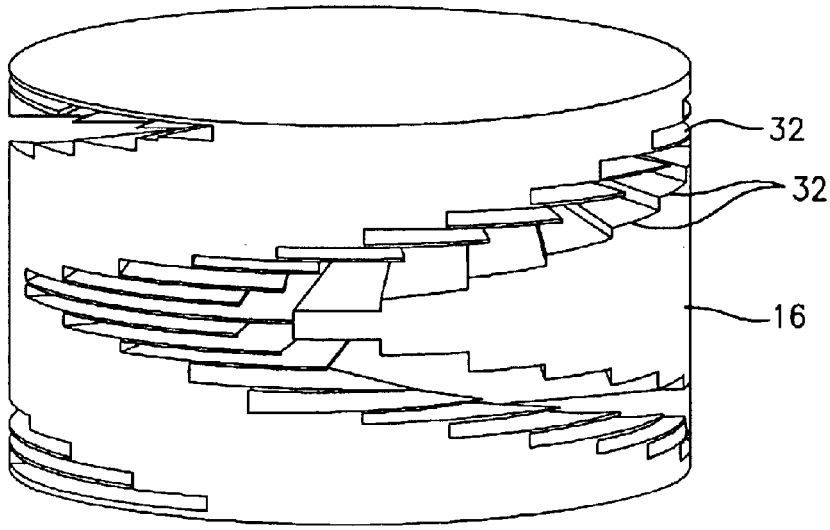
FIG. 3 is a perspective view of a filler ply assembly used in the rotor assembly of FIG. 1.
Figure 4:
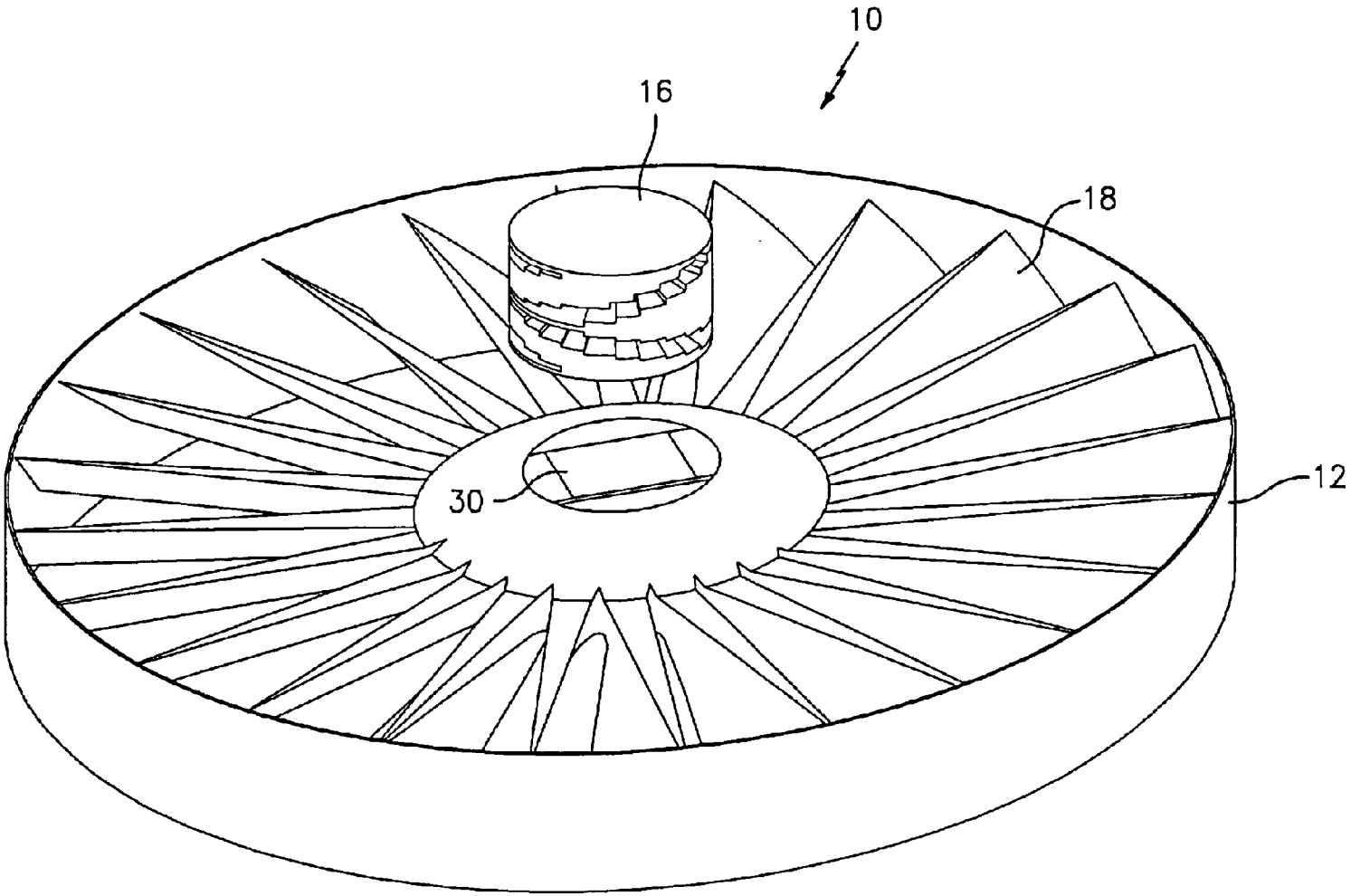
FIG. 4 is an exploded view of the integrally bladed rotor assembly of FIG. 1.

Referring now to FIGS. 3 and 4, the center of the rotor 10 is filled by a filler ply assembly 16. The assembly 16 is formed by a plurality of stacked filler plies 32 formed from a near isotropic, fabric lay-up. As can be seen from FIGS. 3 and 4, the filler plies 32 are arranged in a spiral pattern which matches or compliments the pattern of the spars 20 and 20'. The filler ply assembly 30, in addition to filling the center of the rotor 10, helps distribute the loads on the blades.

The rotor design of the present invention provides numerous advantages. For example, by having the spars 20 run through the inner diameter hub 14 between opposing blades 18, load transfer problems seen in dissimilar material blade/hub designs is eliminated. Further, significant weight savings, i.e. 30% weight reduction, and cost savings, i.e. 75% cost reduction, can be achieved vs. hollow titanium integrally bladed rotors. Also, one can gain major reductions in moment of inertia leading to improved spool up and spool down response.

It is apparent that there has been provided in accordance with the present invention an organic matrix composite integrally bladed rotor which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. An integrally bladed rotor for use in a gas turbine engine comprising:

a plurality of pairs of airfoil blades;

each pair of blades having a spar which extends from a first end tip at an outer end of a first one of said airfoil blades in said pair to a diametrically opposed second end tip at an outer end of a second one of said airfoil blades in said pair;

an outer shroud integrally joined to the first and second tips in each pair of airfoil blades;

each said spar has a first arm and second arm spaced from said first arm in a central portion of said spar;

said first arm and said second arm define an opening and said opening allowing said spars to be interwoven; and a filler ply assembly filling a central portion of said rotor.

2. An integrally bladed rotor according to claim 1, further comprising an inner diameter hub and said spar in each said pair of blades passing through said inner diameter hub.

3. An integrally bladed rotor according to claim 1, wherein said filler ply assembly is formed from a near isotropic, continuous weave fabric lay-up.

4. An integrally bladed rotor according to claim 1, further comprising said spar in each said pair of blades being formed from a composite material.

5. An integrally bladed rotor according to claim 1, wherein said spars associated with said pairs of airfoil blades are interwoven and said filler ply assembly comprises a plurality of stacked filler plies.

6. An integrally bladed rotor according to claim 5, wherein said spars are interwoven in a spiral pattern and said plurality of stacked filler plies are arranged in a complimentary spiral pattern.

* * * * *